US009019366B2

(12) United States Patent
Goldberg et al.

(10) Patent No.: US 9,019,366 B2
(45) Date of Patent: Apr. 28, 2015

(54) LASER POINTER SYSTEM FOR DAY AND NIGHT USE

(75) Inventors: Lew Goldberg, Fairfax, VA (US); Christopher M. McIntosh, Montclair, VA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 1044 days.

(21) Appl. No.: 13/044,580

(22) Filed: Mar. 10, 2011

(65) Prior Publication Data

US 2012/0229622 A1 Sep. 13, 2012

(51) Int. Cl.

| | |
|---|---|
| ***H04N 7/18*** | (2006.01) |
| ***H04N 9/47*** | (2006.01) |
| ***F41G 3/14*** | (2006.01) |
| ***F41G 1/35*** | (2006.01) |

(52) U.S. Cl.
CPC . *F41G 3/145* (2013.01); *F41G 1/35* (2013.01)

(58) Field of Classification Search
CPC .... G01B 11/022; G01B 11/024; F41G 3/145; F41G 1/35
USPC ..... 348/135, 207.99, 723; 353/42; 356/479, 356/614, 305; 250/206; 257/79
See application file for complete search history.

(56) References Cited

U.S. PATENT DOCUMENTS

| | | | | |
|---|---|---|---|---|
| 3,623,671 | A * | 11/1971 | Hargroves | 250/206 |
| 5,914,783 | A * | 6/1999 | Barrus | 356/614 |
| 6,937,331 | B1 * | 8/2005 | Nguyen | 356/305 |
| 2003/0151053 | A1 * | 8/2003 | Sun et al. | 257/79 |
| 2003/0169346 | A1 * | 9/2003 | Ojima et al. | 348/207.99 |
| 2005/0200855 | A1 * | 9/2005 | Mcinnes et al. | 356/479 |
| 2006/0170874 | A1 * | 8/2006 | Yumiki et al. | 353/42 |
| 2006/0238493 | A1 | 10/2006 | Dunton | |
| 2007/0097335 | A1 | 5/2007 | Dvorkis et al. | |
| 2009/0195700 | A1 * | 8/2009 | Yun | 348/723 |

* cited by examiner

*Primary Examiner* — Allen Wong
(74) *Attorney, Agent, or Firm* — Richard J Kim

(57) ABSTRACT

A novel eye-safe, long range laser pointer system for use in day or night conditions is described. The system uses a short pulse laser and a gated camera to detect the laser spot at long ranges in the presence of a strong solar background. The camera gate is synchronized with incident laser pulses using a separate large area, fast photodiode to detect the high peak power pulses. Alternately, gate synchronization using a GPS-disciplined clock can be used. Eye-safe systems operating in the near-UV or SWIR band are described.

10 Claims, 1 Drawing Sheet

LASER POINTER SYSTEM FOR DAY AND NIGHT USE

GOVERNMENT INTEREST

The invention described herein may be manufactured, used, sold, imported, and/or licensed by or for the Government of the United States of America.

FIELD OF THE INVENTION

This invention relates in general to laser pointers, and more particularly to long range, day or night laser pointers.

BACKGROUND OF THE INVENTION

Infrared laser pointers have been used successfully under nighttime conditions for the important applications of target marking and target hand-off, while providing shoot-from-the-hip capability. A laser spot generated by a continuous wave (CW) eye-safe near-infrared (NIR) laser can be observed by standard issue night vision goggles (NVGs) or near-infrared sensitive cameras at long distances. This system, however, only operates under conditions where the background illumination is very low. Under daytime conditions, the IR laser spot becomes indistinguishable from the solar background illumination, rendering the CW laser spot undetectable.

SUMMARY OF THE INVENTION

A novel eye-safe, long range laser pointer system for use in day or night conditions is described. The system uses a short pulse laser and a gated camera to detect the laser spot at long ranges in the presence of a strong solar background. The camera gate is synchronized with incident laser pulses using a separate large area, fast photodiode to detect the high peak power pulses. Alternately, gate synchronization using a GPS-disciplined clock can be used. Eye-safe systems operating in the near-UV or SWIR band are described.

In one aspect, a laser pointer system is disclosed. Such a system comprises a laser capable of emitting short laser pulses; a synchronization photodiode to detect arriving reflections of said short laser pulses; a camera to detect a remote laser spot; and a display to display the position of said laser spot. Said camera is gated synchronously with the laser pulses.

In another aspect, a GPS-based laser pointer system is disclosed. Such a system comprises a laser capable of emitting short laser pulses; a GPS-disciplined clock; a camera that is gated synchronously with said laser pulses based on a GPS signal from said GPS-disciplined clock to detect a remote laser spot; and a display to display the position of said laser spot.

Yet, in another aspect, a laser pointing method is disclosed based on a laser pointer system. Such a method comprises: directing a laser beam of short pulses from a laser towards a distant surface; detecting by a photodiode laser pulses scattered from said laser beam incident on said distant surface; producing a detection signal from a photodiode detection circuit based on said detection of scattered laser pulses; triggering a gated camera based on said detection signal from the photodiode detection circuit so that the gate coincides with the scattered laser pulses incident on the camera to generate a camera image signal; and generating a context image on a display based on said camera image signal. Said context image includes the position of an imaged laser spot shown on said display.

The disclosure can find applications in long range, day or night laser pointer for, e.g., target hand-off, target marking, or shoot-from-hip capability.

BRIEF DESCRIPTION OF THE DRAWINGS

Additional advantages and features will become apparent as the subject invention becomes better understood by reference to the following detailed description when considered in conjunction with the accompanying drawings wherein.

DETAILED DESCRIPTION

Figure 1:
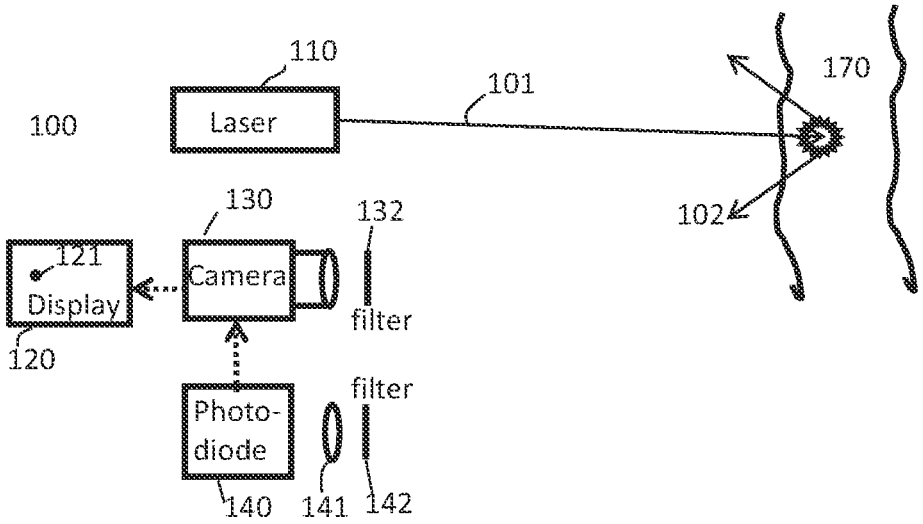
FIG. 1 shows an exemplary laser pointer system.

An exemplary embodiment of a laser pointer system 100 comprises a camera 130 that is gated synchronously with laser pulses 101, a short pulse eye-safe laser 110, a narrow-band spectral filter (132 and/or 142), a photodiode 140 to detect the arriving reflections 102 of the laser pulses and to provide synchronization signal to the camera 130, or a GPS-disciplined clock for synchronizing the camera.

An exemplary laser wavelength for an exemplary embodiment of the daytime pointer system (e.g., 100) is in the near-UV band of 350-399 nm. This wavelength range has several important advantages; a) optical radiation in this wavelength range is relatively eye-safe because it does not penetrate to the retina of the eye, b) the solar background radiation in this wavelength range is low, c) atmospheric transmission is adequate for type of operational range needed for a laser pointer, d) near-UV optical radiation is readily detectable with standard low cost silicon CCD and CMOS cameras, e) large area silicon PIN or APD detectors exhibit high quantum efficiency in this wavelength range and also have a fast response time due to low junction capacitance. Such large area, fast detectors are required for detection of high peak power pulses while achieving a wide field of view for the detection system.

Such an exemplary system configuration, and the essential system components, the pulsed laser 110, synchronization photodiode 140, camera 130, and display 120 are shown in FIG. 1.

Such an exemplary system functions as follows, e.g., a laser pointing method based on a laser pointer system comprises: the laser beam 101, consisting of a train of short pulses, is incident on a distant surface 170 and scattered light (e.g., 102) is detected by the photodiode. The signal from the photodiode detection circuit 140 triggers a gated camera 130 so that the gate coincides with the arrival of the scattered laser pulses 102 at the camera 130. The context image generated by the camera, including the imaged laser spot 121, is shown on a display 120. Image processing can be used to locate the laser spot 121 in the image, and a display overlay indicator can be used to highlight the location of the laser spot on the image. Alternately, a second co-aligned camera can be used to provide an RGB context image while the first camera is used to find the location of the laser spot. The laser spot location is shown on the RGB image display using an overlay indicator. To reduce the contribution of the solar background, narrow-band spectral filters (e.g., 132 or 142) are placed in front of the photodiode 140 and the camera 130, as shown in FIG. 1. The photodetector 140 should have a large area to enable a wide field of view (FOV) detection of the short laser pulses using large diameter, short focal length lenses (e.g., 141). Such large area, fast detectors are only available in silicon and have high sensitivity in the 300-1100 nm band.

Figure 2:
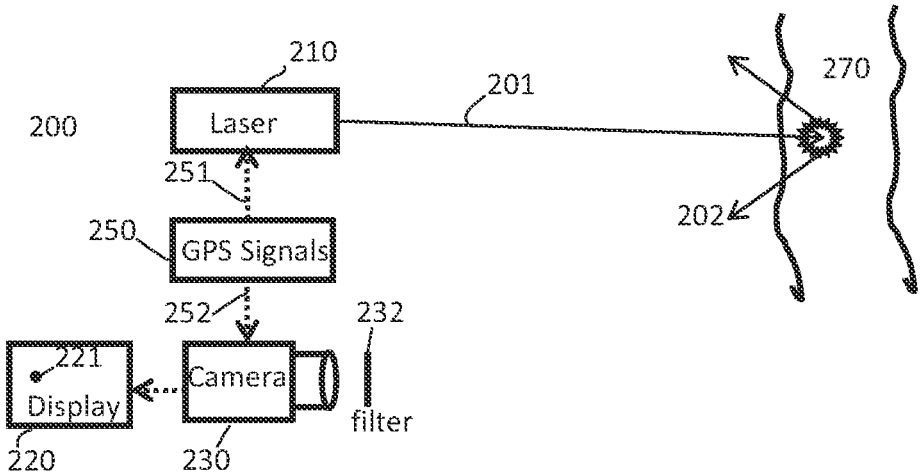
FIG. 2 shows an alternative exemplary laser pointer system.

An alternate exemplary system can be embodied without the synchronization photo detector as shown in FIG. 2. Such an exemplary alternative system uses GPS signals (e.g., 251, 252) to independently synchronize the laser 210 and the camera 230, so that both are mutually synchronized to each other. More specifically, such an alternate exemplary system comprises a camera 230 that is gated synchronously with laser pulses 201 based on a GPS signal 252, a short pulse laser 210 based on a GPS signal 251, a narrow-band spectral filter 232. A GPS-disciplined clock 250 synchronizes the laser 210 and the camera 230 based on GPS signals 251 and 252. The context image generated by the camera, including the imaged laser spot 221, is shown on a display 220. This approach has the advantage of providing camera-to-laser synchronization under conditions when the optical signal reaching the observer is too low to detect using a photodiode. Since this approach does not require large area, fast photodiodes that are only available in silicon, an alternate eye-safe laser wavelength can be used, such as one in the SWIR band of 1400-2000 nm. A convenient wavelength in this band is 1570 nm because of the availability of compact pulsed laser sources based on Q-switched Nd:YAG and optical parametric oscillators (OPOs).

In the near-UV band, a preferred choice of wavelength is 355 nm, corresponding to frequency tripled Nd:YAG lasers operating at 1064 nm. Efficient frequency tripling of Q-switched Nd:YAG lasers can be readily achieved using a two step process of generating the 532 nm second harmonic in the first nonlinear crystal then using a second nonlinear crystal to generate the 355 nm sum frequency by mixing the second harmonic radiation with the remaining 1064 nm fundamental radiation. Typically KTP is used as the frequency doubling crystal and LBO is used as the sum frequency mixing crystal.

Compact optical sources based on frequency conversion (using OPO or frequency tripling) of Q-switched lasers typically generate pulses in the 5-20 nanosecond range, making it possible to use very short camera gate widths of 10-50 microseconds, resulting in strong suppression of the solar background signal. In addition, such short pulse lengths result in very high laser pulse peak powers, making it possible to detect such pulses with the synchronization photodiodes from a long distance.

Such various exemplary day pointer systems as described can circumvent deficiencies associated with the NIR pointer system and make it possible to achieve laser pointing under full sunlight conditions. Short camera gate times and narrow-band spectral filters are used to suppress the solar contribution to sufficiently small levels to allow detection of the laser spot in the camera image. The use of near-UV or SWIR laser wavelengths makes it possible to achieve long range laser spot detection and laser pointing with laser pulse energies and average powers that are eye-safe.

The disclosure can find applications in long range, day or night laser pointer for, e.g., target hand-off, target marking, or shoot-from-hip capability.

It is obvious that many modifications and variations of the present invention are possible in light of the above teachings. It is therefore to be understood that within the scope of the appended claims, the invention may be practiced otherwise than as described.

What is claimed is:

1. A laser pointer system to detect a remote laser spot at long ranges in the presence of a solar background, comprising:

a laser disposed to emit short laser pulses of duration in the 5-20 nanoseconds range incident on a distant surface to mark a remote laser spot;

a synchronization photodiode to detect arriving reflections of said short laser pulses as scattered laser pulses, wherein a first narrow-band spectral filter and a lens are disposed in front of the photodiode;

a camera being triggered by a gating signal of gate width 10-50 microseconds from the synchronization photodiode, wherein a second narrow-band spectral filter is disposed in front of the camera to image said remote laser spot while suppressing the solar background; and a display to display the position of said laser spot, wherein said camera is gated synchronously with the laser pulses based on a camera gate width in the range of 10-50 microseconds.

2. The laser pointer system according to claim 1, wherein said laser pointer system is a long-range, eye-safe day or night laser pointer system operating in the near-UV or SWIR band.

3. The laser pointer system according to claim 1, comprising a second co-aligned camera used to provide an RGB context image while the camera to detect a remote laser spot is used to find the location of the laser spot, the laser spot location being shown on the display using an overlay indicator.

4. The laser pointer system according to claim 1, wherein either said photodiode provides synchronization signal to the camera, or a GPS-disciplined clock synchronizes the camera.

5. The laser pointer system according to claim 1, wherein a photodiode detection circuit triggers gating of said camera so that the gating coincides with the scattered laser pulses incident on said camera, wherein a context image generated by the camera, including the position of an imaged laser spot, is shown on said display.

6. A method to detect a remote laser spot at long ranges in the presence of a solar background based on a laser pointer system, the method comprising:

directing a laser beam of short pulses of duration in the 5-20 nanoseconds from a laser towards a distant surface to mark a remote laser spot;

detecting by a photodiode laser pulses scattered from said laser beam incident on said distant surface, wherein the scattered laser pulses are narrow-band spectral filtered and focused toward the photodiode for detection of the remote laser spot;

producing a detection signal from a photodiode detection circuit based on said detection of scattered laser pulses;

triggering a gated camera with a narrow-band spectral filter disposed in front of the camera based on said detection signal from the photodiode detection circuit, wherein a gate width in the range of 10-50 microseconds is used to be coincident with the scattered laser pulses incident on the camera to image said remote laser spot while suppressing the solar background; and generating a context image on a display, wherein the position of said remote laser spot is shown on said display.

7. The method according to claim 6, wherein image processing is used to locate the laser spot in the context image, and a display overlay indicator is used to highlight the location of the laser spot on the context image.

8. The method according to claim 6, comprising disposing a second co-aligned camera to provide an RGB context image while the gated camera is used to find the location of a laser spot.

9. The method according to claim 8, wherein said laser spot location is shown on the RGB context image display using an overlay indicator.

10. The method according to claim 8, wherein said photodetector has a large area to enable a wide field of view detection of laser pulses using large diameter, short focal length lenses.

* * * * *